US005449858A

United States Patent [19]

Menning et al.

[11] Patent Number: 5,449,858

[45] Date of Patent: Sep. 12, 1995

[54] GUITAR FEEDBACK DEVICE AND METHOD

[75] Inventors: Hunter W. Menning, Orlando; Jonathan D. Phelps, Winter Park, both of Fla.

[73] Assignees: Edward E. Haddock, Jr.; James W. Heavener, both of Winter Park, Fla.

[21] Appl. No.: 176,016

[22] Filed: Dec. 30, 1993

[51] Int. Cl.[6] ..... G10H 3/18

[52] U.S. Cl. ..... 84/727; 84/738; 84/DIG. 10

[58] Field of Search ..... 84/600, 725-728, 84/738, DIG. 10

[56] References Cited

U.S. PATENT DOCUMENTS

| | | | |
|---|---|---|---|
| 3,742,113 | 6/1973 | Cohen . | |
| 3,813,473 | 5/1974 | Terymenko . | |
| 4,075,921 | 2/1978 | Heet . | |
| 4,143,575 | 3/1979 | Oliver . | |
| 4,171,659 | 10/1979 | Tumminaro . | |
| 4,181,058 | 1/1980 | Suenaga . | |
| 4,236,433 | 12/1980 | Holland . | |
| 4,245,540 | 1/1981 | Groupp . | |
| 4,248,120 | 2/1981 | Dickson . | |
| 4,282,789 | 8/1981 | Lamborn | 84/727 |
| 4,697,491 | 10/1987 | Maloney . | |
| 4,852,444 | 8/1989 | Hoover et al. . | |
| 4,907,483 | 3/1990 | Rose et al. | 84/726 |
| 4,920,848 | 5/1990 | Suzuki | 84/600 |
| 5,123,324 | 6/1992 | Rose et al. | 84/726 |
| 5,147,969 | 9/1992 | Hiyoshi et al. | 84/600 |
| 5,189,237 | 2/1993 | Koguchi | 84/609 |
| 5,200,569 | 4/1993 | Moore | 87/723 |

*Primary Examiner*—Stanley J. Witkowski
*Attorney, Agent, or Firm*—Allen, Dyer, Doppelt, Franjola & Milbrath

[57] ABSTRACT

A sound effects device is used with a guitar having an electromagnetic pickup for inducing feedback into an original signal source for creating a unique musical sound. The device comprises a coil winding which is placed on a hand or wrist of a player for maneuvering the hand in proximity to the guitar pickup. In an alternate arrangement, the coil is affixed to a stand and the guitar is maneuvered by the player for placing the guitar pickup close to the coil. The player thus creates new and pleasing sounds by changing relative positions of the guitar and device in proximity to each other thus allowing for an enhanced unrestricted performance.

25 Claims, 3 Drawing Sheets

GUITAR FEEDBACK DEVICE AND METHOD

BACKGROUND OF INVENTION

1. Field of Invention

The invention relates generally to stringed musical instruments and more particularly to musical instruments using feedback to provide sound sustaining special effects.

2. Background Art

U.S. Pat. No. 3,742,113 issued to Marcus S. Cohen on Jun. 26, 1973 discloses a stringed musical instrument with electrical feedback including a means responsive to the vibrations of a string as it is plucked or hit and a means for driving the oscillations of the string electronically. Pickups in the form of coils wound around magnetized cores produce electrical signals responding to the vibrations of the strings. The signals are then amplified and converted to sounds via loudspeakers. The pickups are affixed to the instrument adjacent the strings. Means are disclosed wherein the string's vibrations can be sustained for an arbitrary period of time at its fundamental frequency or at higher harmonics thereof, or at a mixture of fundamental and harmonics, producing a sound rich in overtones unique to the instrument. The player selects which of the plurality of strings will be driven continuously, which will be driven only when played upon, and which will remain undriven.

As described by Cohen '113, the effect of the invention is to make possible the creation of aesthetically pleasing sounds which are entirely different than those created by standard stringed instruments. As pointed out, contemporary musicians have sought and continue to seek methods of achieving effects which are different from those to which audiences are accustomed. Such effects are generally welcomed and have resulted in the creation of new musical forms and techniques.

U.S. Pat. No. 4,075,921 issued to Gregory S. Heet on Feb. 28, 1978 discloses a string instrument vibration initiator and sustainer device which senses the vibration of a string and provides an output driving signal for sustaining the vibration. In one embodiment described, a hand held device is positioned above a vibrating string in an instrument for sensing the vibration of the string. The sensed vibration is electronically amplified and then coupled to a coil which is used to drive the same string. In another embodiment, pickup coils and driving coils are permanently located adjacent to the strings of the instrument.

U.S. Pat. No. 4,245,540 issued to Barry A. Groupp on Jan. 20, 1981 discloses a sound sustaining device for musical instruments such as a guitar which controllably and selectively sustains musical sounds produced by the instrument. The device includes an electrical pickup proximate to the strings of the guitar for generating electrical signals which correspond to the vibrations of the strings. The signals are amplified by the device and are converted to a loudspeaker mounted to the guitar and proximate the strings wherein mechanical vibrations sympathetically reinforce the initial vibrations and maintain the strings in a vibratory state and thereby sustain the sound.

Consideration of some of the many terms and effects used in the musical art will provide appreciation for the art of musical enhancement and special effects and support the teaching of the present invention. By way of example, consider a few such effects and terms. A signal processor comprises an electronic circuit which alters an audio signal in some unique fashion. By way of example, therefore, an equalizer, filter, compressor, phaser, delay line and other similar sound altering devices are considered signal processors. Many signal processors are used for special effects such as flangers and distortion generators (fuzz boxes) used by electric guitarists as discussed in the "Sound Reinforcement Handbook" written for Yamaha by Gary Davis and Ralph Jones. As further described in the Handbook, other signal processors are used to subtly shape the overall sound balance (equalizers), or used to control the perceived spaciousness (reverberation and delay), or to level the wide volume variations in a program (compressors) in such a way that no special effect is perceived. These same devices are used for mild enhancement and extreme special effects. It is these special effects and sound enhancement results with which the present invention deals.

To further appreciate the need for the present invention, consider the following definitions and the methods currently used in the art to create various sound enhancements. As defined in the Handbook, Reverberation consists of multiple, blended sound images (not individually discernible echoes) caused by reflection from walls, floor, ceiling and other surfaces which do not absorb all the sound. Reverberation occurs naturally in most indoor environments, and is more prominent with hard surfaced environments. Reverberation is also created artificially by echo chambers and from electronic reverberators and are used for live sound reinforcement, broadcast and recording.

Flanging was originally achieved using reel-to-reel tape recorders. Two tape recorders would record and play back the same programs, in synchronization. By alternately slowing down the machines, different phase cancellations occur. The slowing down was achieved by applying hand pressure against the flanges of the tape supply reels, hence the term flanging. The alternately slowing down one machine and then the other, with both outputs electronically mixed, causes a series of changing interactions between the two outputs. Reinforcement (addition) and cancellation (subtraction) occurred giving the effect of a sweeping comb filter. The sound can be described as swishing.

Flanging and phasing have a somewhat similar sound but are achieved in different ways in the art. A phase shifting device contains a filter having a very narrow frequency bandwidth. A signal is split, with some of it going into the filter circuitry and some bypassing the filter. Increased phase shift is created at frequencies on either side of the filter notch. By sweeping the notch up and down the frequency spectrum, and mixing the resulting signal back with the direct signal, a series of ever changing phase cancellations occurs. Phasing, as well as the aforementioned effects, are especially popular for guitars, keyboards and vocals.

SUMMARY OF INVENTION

A method for producing varying sound effects for audio instruments of the type having an electromagnetic pickup comprises the steps of placing an inductive coil on a hand of a musician playing an instrument, receiving an electrical signal representative of a musical sound, and amplifying the electrical signal to a level for electrically cooperating with the inductive coil and producing an amplified signal. The coil is then energized with the amplified signal representative of the musical sound for providing a driving signal to an electromagnetic pickup cooperating with the instrument played by the musician. The hand of the musician is then moved proximate the pickup for driving the pickup and providing varying audio effects to the instrument.

The method further comprises processing the electrical signal, and fitting the inductive coil to an article worn by the player such as a glove worn on the hand of the player.

In the preferred embodiment of the invention, the instrument comprises an electric guitar of the type having an electromagnetic pickup affixed proximate the strings of the guitar. In addition, the electrical signal representative of a musical sound comes from the guitar being played and the driving signal provides a feedback signal to the pickup. In alternate embodiments, a multiplicity of instruments having varying outputs representative of their individual musical sounds is provided. The outputs from such instruments are processed for cooperating with the inductive coil and for providing electrical signals representative of the individual musical sounds. The inductive coil is alternately energized with one of the electrical signals representative of the corresponding one instrument for providing the feedback signal to the guitar being played.

In yet another embodiment of the invention, the coil drives a speaker for providing acoustical coupling feedback from the speaker. The coil is affixed to a glove in the preferred embodiment but is affixed to various body portions in alternate embodiments for providing a creative approach to permitting the musician to bring the coil proximate the pickup while playing the instrument. In such an arrangement, the coil is affixed to a wrist band worn by the musician for moving the coil while permitting hands to be free for playing the guitar.

A multiplicity of coils and pickups are used in varying combinations. In one embodiment, multiple inductive coils are provided. Multiple audio signals each representative of an individual source sound information are received and each is processed for cooperating with a corresponding inductive coil. The coils are moved proximate the pickup for mixing the source sound information received by the pickup. With multiple coils, a further extension of the inventive method comprises affixing the multiplicity of coils to operative positions on a musician or instrument player for permitting the player to move an individual coil proximate the pickup. The pickup output is processed for recording, broadcasting or amplifying the mixed sound. Further steps in the inventive process include equalization of the various signals as one processing step. Alternatively, a multiplicity of pickups is provided. The inductive coil is moved about the pickups in a position proximate one of the pickups, then to another position proximate another pickup for driving the pickups.

It is an object of the invention to provide various creative audio effects for musical instruments by driving pickups used with the musical instrument. It is a particular object of the invention to provide a feedback signal to a pickup used on an electric guitar such that the feedback signal can be simply and creatively applied by the player while the guitar is being played. It is further an object of the invention to provide a method whereby the player can create varying feedback effects by adding various enhancing processed signals generated by the instrument as the source of the sound or by other source sounds. It is an object of the invention to provide a method to the musician for simply and creatively mixing multiple signals during a performance.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1A:
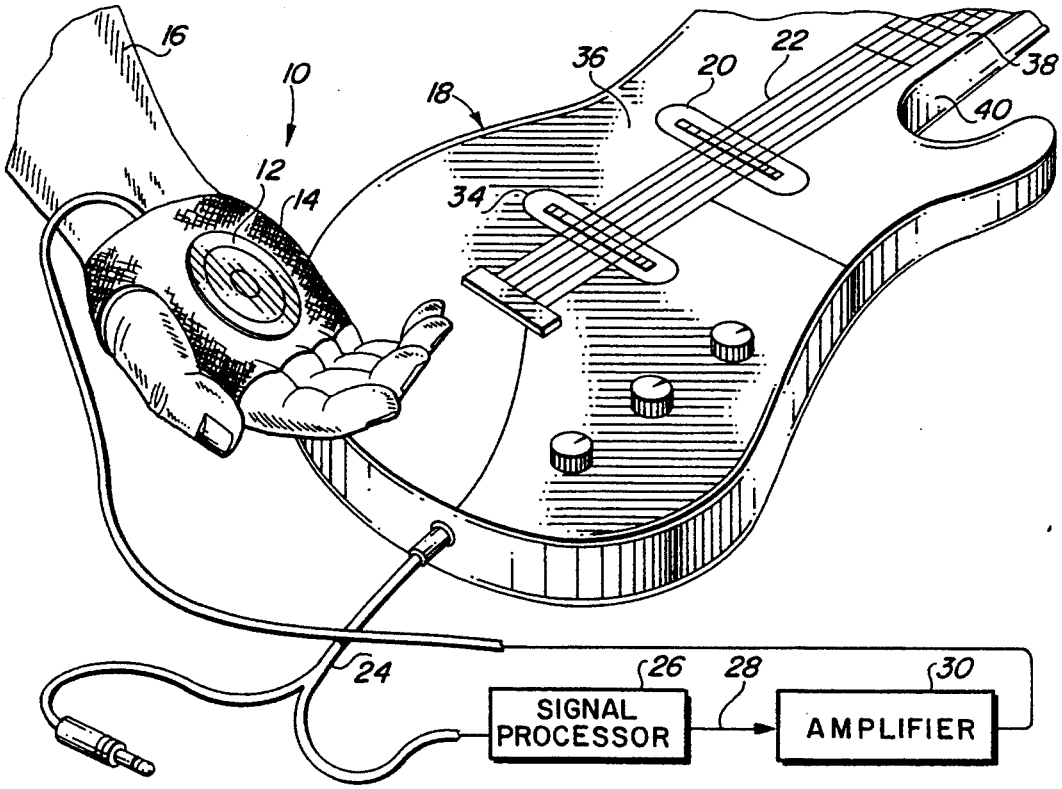
FIG. 1*a* is a partial perspective view of a guitar and player illustrating a preferred embodiment of the invention having coil affixed to a glove worn by the player.
Figure 2:
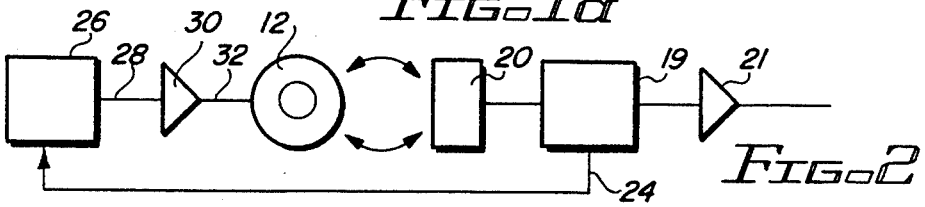
FIG. 2 is a functional block diagram illustrating the functional flow of the invention of FIG. 1 using the guitar as the source sound.

A detailed description of the preferred embodiment and alternate embodiments is now described with reference to the drawings. With reference to FIG. 1*a*, the preferred embodiment of the invention is a sound enhancement effects device 10 comprising an inductive coil 12 affixed to a glove 14 worn by a musician or player 16 of an instrument such as a guitar 18 in an alternate embodiment of the device 11 as illustrated with reference to FIG. 1*b*, the coil 12 is affixed to a wrist band 13 worn by the player 16. In the preferred embodiment, an electric guitar 18 of the type having an electromagnetic pickup 20 is used. The pickup 20 is responsive to the vibration of the strings 20 when struck by the player 16. An electrical output signal 24 from the pickup 20 is typically delivered to a power amplifier 21 as illustrated in FIG. 2 for driving sound speakers during a performance or recording the performance. In the present invention, the signal 24 is also amplified and used to energize the coil 12. The energized coil 12 provides an additional driving signal to the pickup 20 when the coil 12 is brought into proximity to the pickup 20. Such a signal provides feedback to the pickup 20 which enhances the output signal 24 used in the performance. By wearing a glove 14, or wrist band 13 the player 16 is free to use fingers and hand to play the instrument 18.

Figure 1B:
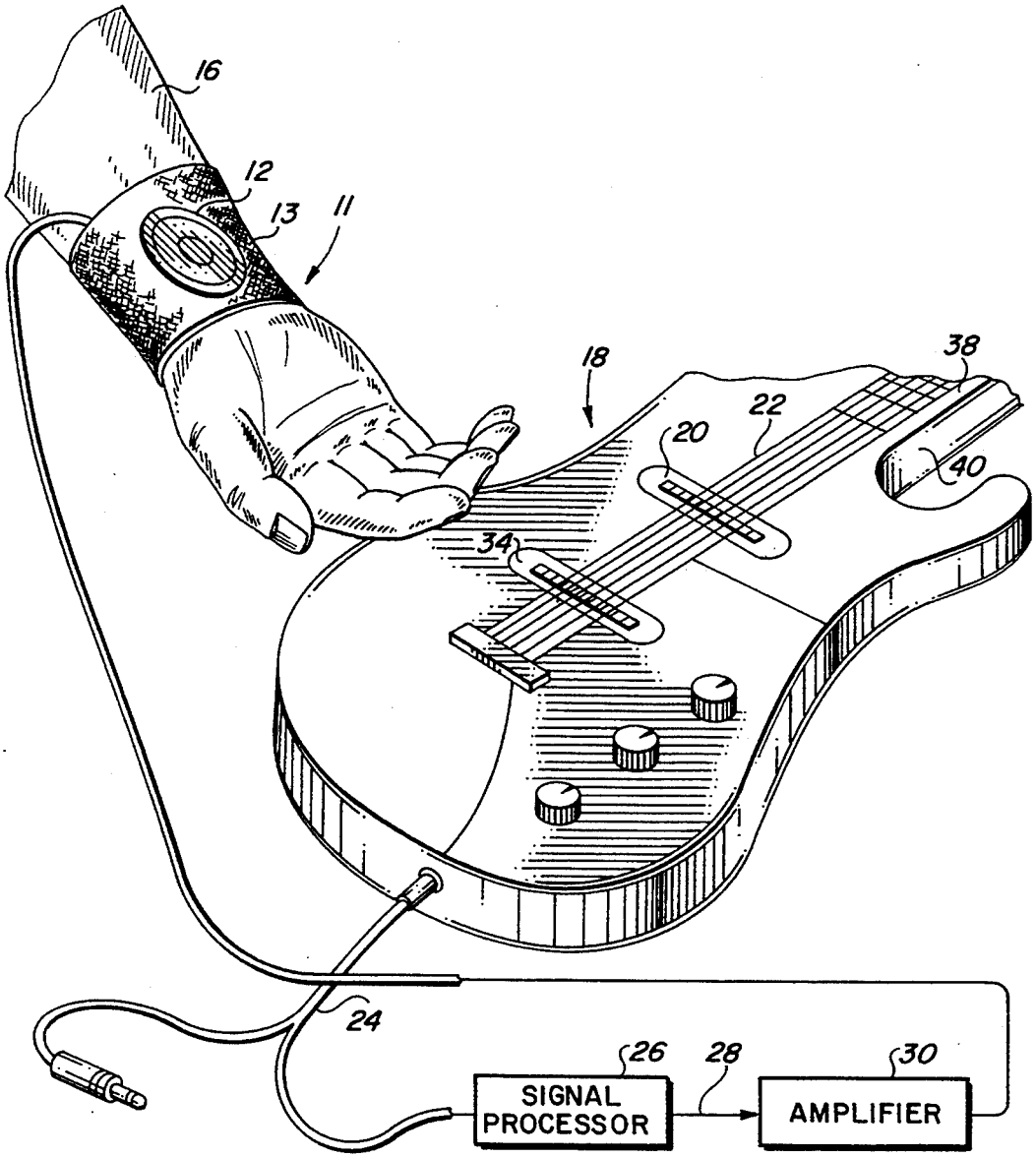
FIG. 1*b* is a partial perspective view of a guitar and player illustrating an alternate embodiment of the invention having the coil affixed to a wrist band worn by the player.

With further reference to FIGS. 1*a*, 1*b* and FIG. 2, the output signal 24 is delivered to a processor 26. The processor 26 provides a line level signal 28 to an amplifier 30 which provides an amplified signal 32 sufficient to drive the coil 12. The field delivered by the coil 12 causes the pickup 20 to respond to the field whereby the feedback signal is delivered. A second pickup 34 is used as well as multiple pickups such as those on a Fender American Standard Stratocaster electric guitar used during the testing and development of the invention.

By way of example and further explanation, the strings 22 are plucked and begin to vibrate. The vibration of the strings 22 cause an induced current to flow through the pickup 20 in the guitar 18. The electromagnetic pickup 20 comprises a coil affixed proximate to a magnet (not shown). As the current flows through the guitar pickup 20 and optionally through electronics inside of the guitar 18 itself, a low voltage level output 24 typically referred to as a line level output is produced representative of the pickup signal. The low voltage is in the order of tenths of a volt. Some guitars 18 offer an active output wherein the pickup signal is amplified by guitar electronics 19 to approximately one volt. Such is the case in active guitars versus passive guitar systems.

Thus the vibrating strings 22 cause an induced current flow through the pickup to the output of the guitar. The sound is enhanced by an optional addition of the signal processor 26 comprising programming presets for programming parameters such as equalization, delay, reverberation, flanging, phasing, and chorusing. The output of the signal processor 26 is typically the line level signal 28. Some amplification may be provided but the output is still at a low voltage level going into the amplifier 30 which boosts the signal up to approximately five to fifteen volts. In certain cases where severe effects are being sought, levels up to 20 volts are provided. The purpose of the increased voltage is for driving the coil 12. The coil is held in the glove 14 on a hand in one embodiment and mounted on a stand (not shown) proximate the player/musician 16 in an alternate embodiment. The musician 16 moves the guitar pickup 20 toward and away from the device coil 12 for creating various effects.

By way of example in using the glove 14 embodiment, the coil 12 that now has a sound signal 32 from the amplifier is moved close to the electromagnetic pickup 20 of the guitar. The electromagnetic pickup 20 is the original sound source. The electromagnetic field builds up and causes a sustaining tone. When the device 10 is placed close enough to the pickup 20, a very strong field is created which forces the strings 22 into substantially continuous vibration. The higher the voltage applied to the coil 12, the farther away from the pickup 20 the effect is realized. Moving the coil 12 in a creative fashion provides a resulting creative effect unique to the player 16 and the performance.

The glove 14 permits the player 16 to finger pick the strings 22 and move within one effect zone 36 close to the guitar pickup 20 and away from the pickup 20 to another zone 38 out along the neck 40 where a varying effect is sought. By way of example, in the event that a cord is played in the prior art, a delay is stopped by moving a fader or switch on a console operated by a sound engineer. With the present invention, the player/guitarist would play sounds with digital delay repeating pulses of those sounds until the player simply moves the hand with the coil 12 away from the pickup 20 and the delayed sound effect fades away or even instantaneously stops the delay while continuing to play the guitar. Moving the coil 12 back towards the pickup 20 causes the effect to again feedback. This eliminates the need for a sound engineer/mixer. For the player 16 that wants a distorted effect, the voltage of the signal 32 is increased to approximately twenty volts and the device 10 is moved anywhere desired to create what is referred to as a "Jimmy Hendrix distortion". Effects are thus created by the relative distance and movement between the coil 12 and the pickup 20.

The device coil 12 in the described example provides an electromagnetic effect. In the event that acoustic effects are desired such as for a vocalist or acoustic guitarist, a speaker (not shown) is used in place of the coil 12. The speaker coil is the coil 12 for this embodiment. The speaker is pointed toward a vocalist's microphone or played into the sound hole of the acoustic guitar.

Figure 3:
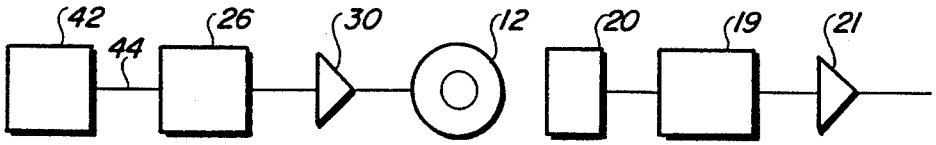
FIG. 3 is a functional block diagram illustrating the use of an independent source sound used to drive the coil of the invention.

FIG. 2 is a schematic diagram of the functional flow described with reference to FIGS. 1*a* and 1*b*. In the embodiment described, the source sound 24 comes from the instrument 18 being played. With reference to FIG. 3, it is appreciated that the invention can be configured using alternate source sounds. In the alternate embodiment illustrated in FIG. 3, an independent source of sound 42 provides a signal 44 to the processor 26 or directly to the amplifier 30 if desired by the player 16 depending on the effect being created.

Figure 4:
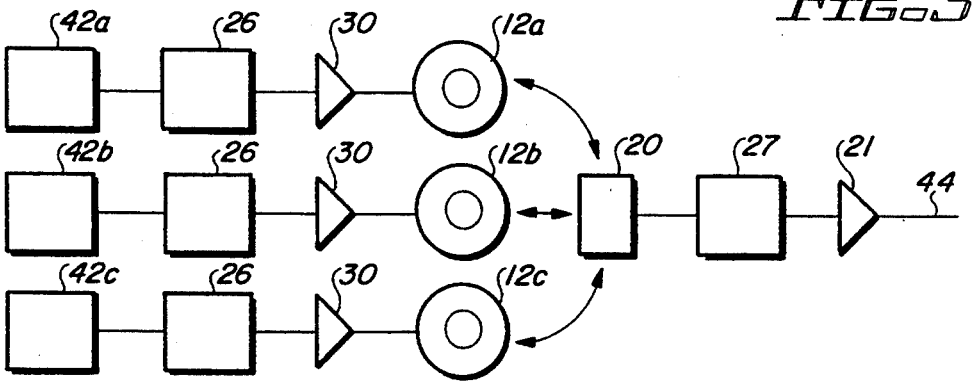
FIG. 4 is a functional block diagram illustrating the use of multiple source sounds for driving multiple coils.

In yet another embodiment of the invention, as illustrated in FIG. 4, a multiplicity of device coils 12*a*, 12*b*, and 12*c* are placed on various body portions such as feet, knees and both hands for delivering a driving signal to the pickup 20. The pickup 20 thus performs as a master volume device for mixing an entire song my moving the coils 12*a*, 12*b*, and 12*c* in proximity to the pickup 20. The sound sources 42*a*, 42*b*, and 42*c* are provided by other instruments such as a drum set, another guitar, and vocal. This embodiment of the inventive method provided results in mixing volumes of audio sounds which in the art is typically done with consoles and involved electronics using variable resistors (not shown). The variable resistors are used wherein an analog signal passes through the resistors of the a console or in a voltage controlled amplifier which has a variable resistor controlling it. The embodiment described and functionally illustrated in FIG. 4 using the multiple coils 12*a*, 12*b*, and 12*c* employs no resistors at all. It is entirely coil-based audio mixing. In this embodiment, a drum kit plays through the coil 12*a*, by way of one example. An electric guitar is energized in the coil 12*b* affixed on the left hand, the right hand has the drums, the right knee has a bass guitar, the player's head yet another instrument signal. Elbows will have yet another instrument. The coils 12*a*, 12*b*, and 12*c* are moved, as described earlier, closer to and away from the master pickup 20 mounted on a stand near the player. A master output 44 of all these combined signals is delivered for the purpose of mixing the signals without the typical variable resistor systems.

Optionally, processors 26 are used to reshape the source sound signals and the pickup coil 20 signal can also be sent through a processor 27 before being delivered to the master output 44.

It was observed in testing for such special effects, that the coils and pickups do not require full audio frequency response outputs. With equalization and processing of the source sounds as earlier described, resulting sounds can have varying frequency spectrums depending on the effect desired.

Figure 5:
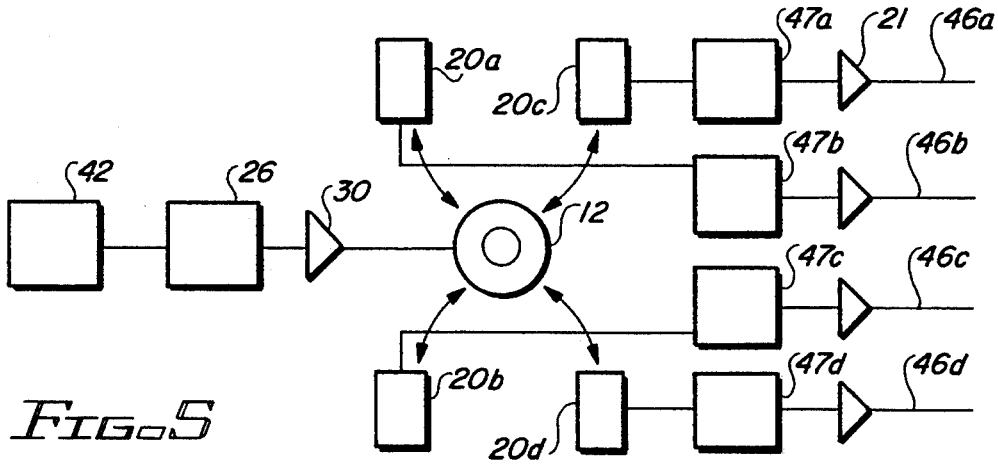
FIG. 5 is a functional block diagram illustrating the use of a single source sound and coil for driving multiple pickups.

With reference to FIG. 5, an alternative embodiment using a multiplicity of pickups 20*a*, 20*b*, 20*c*, and 20*d* shown by way of example with a single source sound 42 feeding the coil 12 maneuvered by the player. Such an arrangement is used to create yet another special effect left only to the imagination of a player. The coil 12 is moved in proximity to the various pickups 20*a*, 20*b*, 20*c* and 20*d*, where the signal received by the pickup 20 is processed and for example used to drive sound speakers located to create a three dimensional effect in a room. The sound can be musical or simply a sound delivering information to the listener from an appropriate location in the room. With multiple pickups, mixing with three dimensions is achieved.

Figure 6:
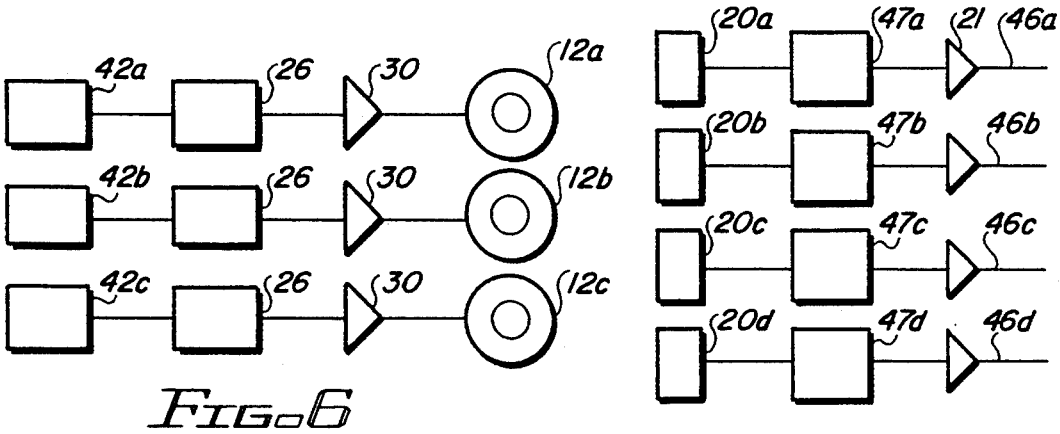
FIG. 6 is a functional block diagram illustrating the use of multiple source sound signals to multiple coils for driving multiple pickups.

With multiple sound sources and multiple pickups, three dimensional mixing is further extended. With reference to FIG. 6 and by way of example, three sound sources 42*a*, 42*b* and 42*c* are provided in this embodiment of the invention. Each sound source 42*a*, 42*b* and 42*c* is processed as discussed earlier using a signal processor 26 if desired. An amplifier 30 drives the individual coils 12*a*, 12*b* and 12*c* wherein each coil 12 contains its individually processed source sound 42 as a player brings a coil 12*a*–12*c* proximate a pickup 20*a*–20*d* as described earlier.

Again with reference to FIGS. 5 and 6, each pickup 20*a*–20*d* has its signal processed as desired. By way of example, equalizers 47*a*–47*d* are used to shape the signal from the pickups 20*a*–20*d* respectively and ultimately amplified 46*a*–46*d* to drive speakers located in various locations in a room.

Figure 7:
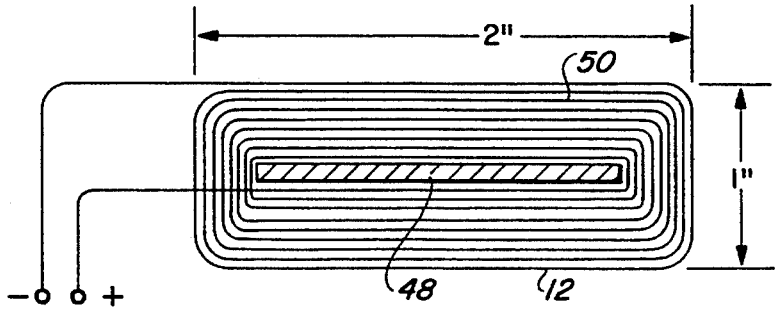
FIG. 7 illustrates one embodiment of the coil.

Coils 12 comprising 20 AWG wire down to approximately 36 AWG wire have been tested and the test showed no preference in creating a special effect. It is convenient to wind the coil 12 in a donut shape as illustrated in FIGS. 1*a* and 1*b*, however, a rectangular shaped coil as illustrated in FIG. 7 provides an alternate arrangement. In one embodiment tested, a center of the coil 12 has a flat metal element 48 dimensioned approximately $1/16'' \times \frac{3}{8}'' \times 1\frac{1}{2}''$. The windings 50 are comprised of ten turns of 22 AWG magnet wire. The device 10 operates without the metal element 48 and with standard electrical wire.

Figure 8:
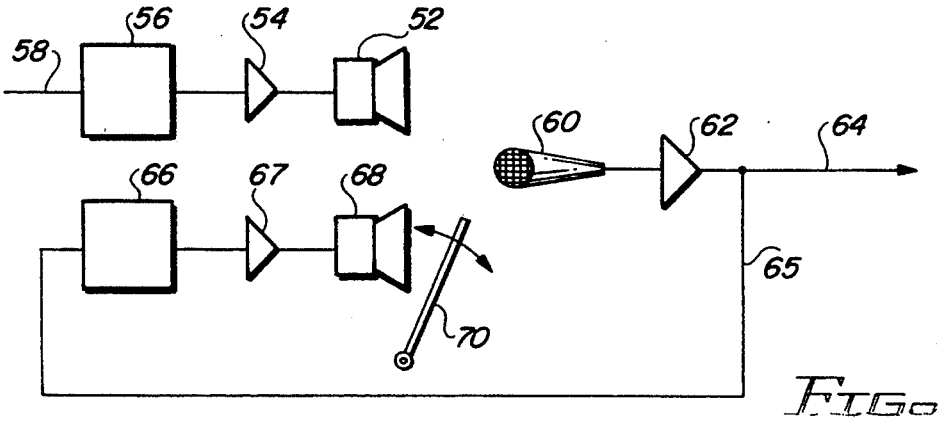
FIG. 8 illustrates an alternative embodiment of the invention wherein speakers are used to provide acoustic coupling and feedback effects.

As described earlier, the coil 12 is replaced by a speaker for providing acoustical feedback or input to a microphone or acoustic guitar. In yet another embodiment of the invention as illustrated in FIG. 8, a first speaker 52 is driven by an amplifier 54 which amplifies a signal from a processor 56. As discussed earlier, an input signal 58 can be provided directly without processing. The first speaker 52 is then brought proximate an acoustic guitar (not shown) or microphone 60 as illustrated in FIG. 8 by way of example. The microphone 60 then has its signal amplified by a pre-amp 62 for providing an output signal 64 to a mixing console (not shown), amplifier or device appropriate for the effect being sought. This description is analogous to the embodiment described in FIG. 3 where the coil 12 and the pickup 20 are represented by the first speaker 52 and the microphone 60 respectively.

In the alternative embodiment illustrated in FIG. 8, the output signal 64 is also fed as a feedback signal 65 through a processor 66 and an amplifier 67 which provide a signal to a second speaker 68. As discussed earlier, the processor 66 is optional based on the desires of the player. The second speaker 68 is brought proximate the microphone 60 for providing an audio feedback signal. As illustrated in FIG. 8, feedback is provided for an external source.

With the use of the second speaker 68, the input 58 from an external second source such as a plucked guitar string or a vocal is the source for the feedback signal 65. In the preferred embodiment, a damper 70 is used in conjunction with the second speaker 68. The feedback effect coupled with the manipulation of the damper 70 offers a sound artist, engineer or the player the ability to create desirable controlled feedback sounds developed from an external source.

While specific embodiments of the invention have been described in detail herein above, it is to be understood that various modifications may be made from the specific details described herein without departing from the spirit and scope of the invention as set forth in the appended claims.

In the foregoing description, certain terms have been used for brevity, clearness and understanding, but no unnecessary limitations are to be implied therefrom beyond the requirements of the prior art, because such words are used for descriptive purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions and methods are set forth in the appended claims.

What is claimed is:

1. A method for producing varying sound effects for audio instruments of the type having an electromagnetic pickup, the method comprising the steps of:

placing an inductive coil on a hand of a musician for freeing fingers of the hand playing an instrument the instrument having an electromagnetic pickup for providing an electrical signal representative of a musical sound;

amplifying the electrical signal to a level for electrically cooperating with the inductive coil and producing an amplified signal;

energizing the inductive coil with the amplified signal for providing an electromagnetic signal to the electromagnetic pickup; and moving the hand of the player relative to the pickup for providing varying audio effects to the instrument by placing the coil proximate the pickup while out of contact with the instrument.

2. The method as recited in claim 1, further comprising the step of processing the electrical signal.

3. The method as recited in claim 1, further comprising the step of fitting the inductive coil to an article worn by the player for freeing fingers of the hand playing the instrument.

4. The method recited in claim 3, wherein the article comprises a glove worn on the hand of the player.

5. The method as recited in claim 1, wherein the instrument comprises an electric guitar of the type having an electromagnetic pickup affixed proximate the strings of the guitar.

6. The method as recited in claim 1, further comprising the steps of:

providing a multiplicity of instruments having varying outputs representative of their individual musical sounds;

processing the outputs for cooperating with the inductive coil and providing electrical signals representative of the individual musical sounds; and alternatively energizing the inductive coil with one of the electrical signals representative of the corresponding one instrument for providing the feedback signal to the instrument being played.

7. The method as recited in claim 1, further comprising the step of driving a speaker with the coil for providing acoustical and electromagnetic feedback from the driven speaker and the coil.

8. A method for producing varying musical sound effects with an electrical guitar, the method comprising the steps of:

providing an electric guitar of the type having an electromagnetic pickup responsive to a multiplicity of strings vibrating individually and in combination;

receiving an electrical output from the electromagnetic pickup affixed proximate strings of the guitar, the electrical output representative of a musical sound from the guitar;

amplifying the electrical output to a level for energizing an inductive coil and providing a signal representative of the electrical output of the pickup;

energizing an inductive coil with the signal; and moving the inductive coil proximate the pickup while out of contact with the guitar for providing a feedback signal to the pickup for driving the pickup.

9. The method as recited in claim 8, wherein the moving step comprises a guitar player moving the guitar proximate while out of contact with the coil for providing the feedback signal, the coil affixed proximate the guitar player.

10. The method as recited in claim 8, further comprising the steps of:

affixing the coil to a body portion of a guitar player while freeing fingers of the player for playing the guitar; and moving the body portion proximate the pickup.

11. The method as recited in claim 10, wherein the step of affixing the coil to a body portion comprises providing a glove worn on a hand and affixing the coil to the glove for moving the coil with the hand while permitting fingers of the hand to remain free for playing the guitar.

12. The method as recited in claim 10, further comprising the step of affixing the coil to a wrist band worn by the player for moving the coil while permitting hands to be free for playing the guitar.

13. A method for producing varying sound effects, the method comprising the steps of:

providing an inductive coil for moving proximate while out of contact with a pickup;

receiving an audio signal representative of source sound information;

amplifying the audio signal to a level for electrically cooperating with the inductive coil and producing an amplified audio signal;

energizing the inductive coil with the amplified audio signal for providing an electrical driving signal to the pickup; and moving the inductive coil proximate while out of contact with the pickup for providing the driving signal to the pickup, the proximity of the coil to the pickup determining the strength and effect of the audio signal on the pickup.

14. The method as recited in claim 13, further comprising the steps of:

providing multiple inductive coils;

receiving multiple audio signals each representative of an individual source sound information;

processing each of the audio signals for cooperating with a corresponding inductive coil; and moving the coils proximate the pickup for mixing the source sound information received by the pickup.

15. The method as recited in claim 14, further comprising the step of affixing the multiplicity of coils to operative positions on a player for permitting the player to move an individual coil proximate the pickup while freeing fingers of a hand playing.

16. The method as recited in claim 14, further comprising the step of processing the mixed source sound information output by the pickup.

17. The method as recited in claim 14, further comprises the step of amplifying the mixed sound output from the pickup for driving sound speakers.

18. The method as recited in claim 13, further comprising the step of processing the audio signal.

19. The method as recited in claim 18, wherein the processing step comprises the step of equalizing the received audio signal.

20. The method as recited in claim 13, further comprising the steps of:

providing a multiplicity of pickups;

alternately moving the inductive coil proximate from a position proximate one of the pickups to another position proximate another pickup for driving the pickups.

21. The method as recited in claim 14, further comprising the steps of:

providing a multiplicity of pickups; and moving each of the multiplicity of coils from a position proximate one of the multiplicity of pickups to another position proximate another pickup for driving the pickup.

22. The method as recited in claim 13, wherein the inductive coil comprises a speaker and the pickup comprises a microphone positioned for receiving audio signals from the speaker.

23. The method as recited in claim 22, further comprising the steps of:

providing a second speaker;

driving the second speaker with an amplified feedback signal from the microphone; and moving the second speaker proximate the microphone for providing an audio signal to the microphone.

24. The method as recited in claim 23 further comprising the step of damping the audio signal provided to the microphone.

25. The method as recited in claim 23, further comprising the step of processing the feedback signal.

* * * * *